US007984861B2

(12) United States Patent
Chang

(10) Patent No.: US 7,984,861 B2
(45) Date of Patent: Jul. 26, 2011

(54) HYDRANT APPARATUS AND WATER DISCHARGING METHOD

(76) Inventor: Chia-Jun Chang, Tai Pei (TW)

( * ) Notice: Subject to any disclaimer, the term of this patent is extended or adjusted under 35 U.S.C. 154(b) by 459 days.

(21) Appl. No.: 12/128,353

(22) Filed: May 28, 2008

(65) Prior Publication Data

US 2008/0295890 A1 Dec. 4, 2008

(30) Foreign Application Priority Data

May 28, 2007 (TW) ..... 96118895 A

(51) Int. Cl.
*G05D 23/02* (2006.01)
*G05D 23/08* (2006.01)

(52) U.S. Cl. ... 236/93 R; 236/21 B; 236/87; 236/101 E; 137/457; 137/468

(58) Field of Classification Search ..... 236/12.14, 236/12.15, 21 R, 21 B, 87, 93 R, 101 R, 101 E; 137/457, 468
See application file for complete search history.

(56) References Cited

U.S. PATENT DOCUMENTS 5,397,053 A * 3/1995 Ewing et al. ..... 236/93 B
5,584,432 A * 12/1996 Lockhart ..... 236/93 B
5,647,530 A * 7/1997 Lorch ..... 236/12.14

FOREIGN PATENT DOCUMENTS

| | | |
|---|---|---|
| CN | 2090904 | 12/1991 |
| TW | 155327 | 11/1990 |
| TW | 349619 | 2/1997 |
| TW | 383827 | 3/2000 |
| TW | 423626 | 2/2001 |

* cited by examiner

*Primary Examiner* — Marc E Norman
(74) *Attorney, Agent, or Firm* — Muncy, Geissler, Olds & Lowe, PLLC

(57) ABSTRACT

A hydrant apparatus comprises at least an outlet pipe, at least a switch for controlling the water flow, and at least a temperature limiting component. The outlet pipe is used for flowing water out of the hydrant apparatus. The switch, coupled to the outlet pipe, is used for controlling the water flow and adjusting the temperature of the water flow. The temperature limiting component limits the temperature of the water flow inside a predetermined range.

8 Claims, 4 Drawing Sheets

HYDRANT APPARATUS AND WATER DISCHARGING METHOD

BACKGROUND OF THE INVENTION (a) Field of the Invention

The invention relates to a temperature control apparatus, particularly to a hydrant apparatus to prevent a user from being scald or frostbite.

(b) Description of the Related Art

In daily life, scald occurs from time to time when using a hydrant apparatus. Scald causes not only physical but also psychological pains. Especially, as the victim of such occasion is usually a small kid that is not taken good care by his parents, the problem becomes more serious.

In order to solve this problem, additional means are used to lower or raise water temperature in the early days or to just prevent the water pressure of the hot water or cold water in use from being suddenly lowered or raised. Or, a scald-proof handle is installed. However, these methods do not help the scald due to negligent behavior.

BRIEF SUMMARY OF THE INVENTION

In light of the above-mentioned problem, the invention provides a hydrant apparatus and a water discharging method to prevent a user from being scalded or frostbitten.

One embodiment of the invention provides a hydrant apparatus, comprising at least an outlet pipe, at least a switch for controlling the water flow, and at least a temperature limiting component. The outlet pipe is used for flowing water out of the hydrant apparatus. The switch, coupled to the outlet pipe, is used to control the water flow or adjust the temperature of the water flow, or both of controlling and adjusting the water flow. The temperature limiting component limits the temperature of the water flow within a predetermined range.

One embodiment of the invention provides a water discharging method. The method comprises the following steps. At first, a user opens at least one switch of the hydrant apparatus to prepare for supplying water flow. Then, temperature control means are provided to determine whether the temperature of the water flow is beyond a predetermined range or not at the moment when the hydrant apparatus is opened. The temperature control means intercept the water flow to prevent water from flowing out of the hydrant apparatus if the temperature is beyond or below the predetermined range; and have the water flow out of the hydrant apparatus if the temperature is within the predetermined range.

The hydrant apparatus and the water discharging method according to the invention utilize the temperature control means, such as temperature limiting component, to limit the temperature of water flow to thereby control the water temperature within a safe temperature range for human beings at the moment when the hydrant apparatus is opened. In addition, the water temperature is controlled within a predetermined range while the hydrant apparatus is in use. Therefore, the hydrant apparatus and the water discharging method according to the invention can prevent a user from being scalded or frostbitten at the moment when the hydrant apparatus is opened and while the hydrant apparatus is in use. Thus, safety protection while using a hydrant apparatus can be achieved.

DETAILED DESCRIPTION OF THE INVENTION

Figure 1:
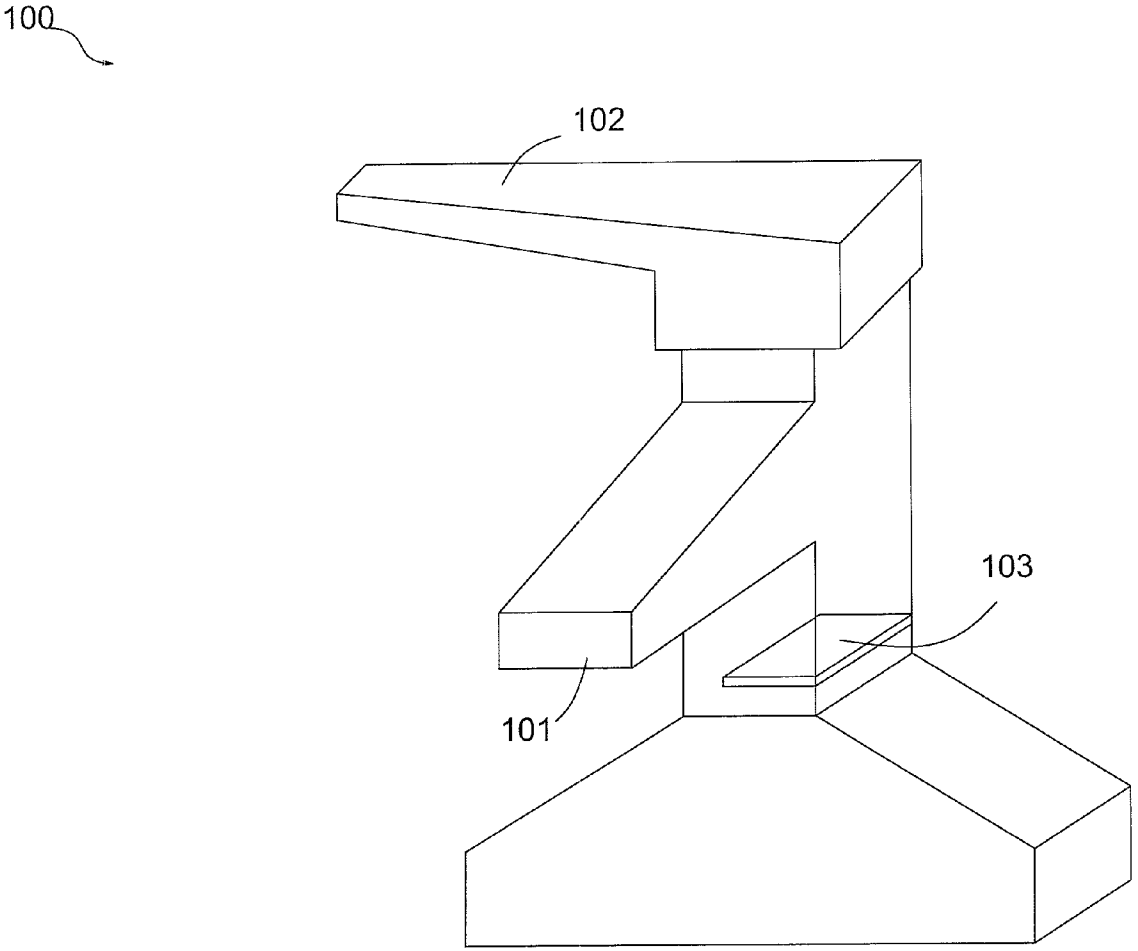
FIG. 1 shows a schematic diagram illustrating the hydrant apparatus according to one embodiment of the invention.

FIG. 1 shows a schematic diagram illustrating the hydrant apparatus 100 according to one embodiment of the invention. As shown in the figure, the hydrant apparatus 100 comprises at least an outlet pipe 101, at least a switch 102, and at least a temperature limiting component 103. It should be noted that the temperature limiting component 103 can be a throttle valve made of shape memory alloys. The temperature limiting component 103 can be made of other current-existed or future-developed material having a shape change property changing along with temperature. On the other hand, the temperature limiting component 103 can be designed to maintain a certain shape within a predetermined temperature range to have water flow out of the outlet pipe 101 normally and to change shape thereof at the temperature that is beyond the predetermined temperature range so as to block the water flow pathway of the hydrant apparatus to stop water flowing out of the outlet pipe 101. Therefore, when a user opens the hydrant apparatus 100, the user will not be hurt by hot water. Besides, after the hydrant apparatus is opened for a while, the higher water temperature in the predetermined temperature range can be used.

In this embodiment, the temperature limiting component 103 is installed in the outlet pipe 101. When the switch 102 is pushed up, water flow starts. When the switch 102 is pushed down, water flow stops. When the switch 102 is rotated clockwise, the temperature of the water flow is raised. When the switch 102 is rotated counterclockwise, the temperature of the water flow is lowered. Certainly, the operation of the switch 102 and the corresponding result thereof are not limited to the above mentioned manner. For example, in another embodiment, as the switch 102 is rotated clockwise, the temperature of the water flow is lowered.

The following will describe the working principle of the hydrant apparatus 100 according to the embodiment of the invention. For the hydrant apparatus 100 shown in FIG. 1, when the switch 102 is opened, water flows through the temperature limiting component 103 and the outlet pipe 101. As the water temperature is still within the predetermined range, for example 30~50° C., the temperature limiting component 103 has no any act. As the switch 102 is rotated clockwise, the water temperature is gradually raised. Or, when the switch 102 is opened, it is at the position to have the high temperature. Once the water temperature is beyond the predetermined temperature range, for example 100° C., the temperature limiting component 103 blocks the water flow pathway of the outlet pipe 101 due to the characteristic of shape memory alloys. The water flow can not continue flowing out and the water flow with high temperature is restricted. Thus, the temperature of the water flow is limited so that the scald due to high water temperature can be prevented.

Figure 2:
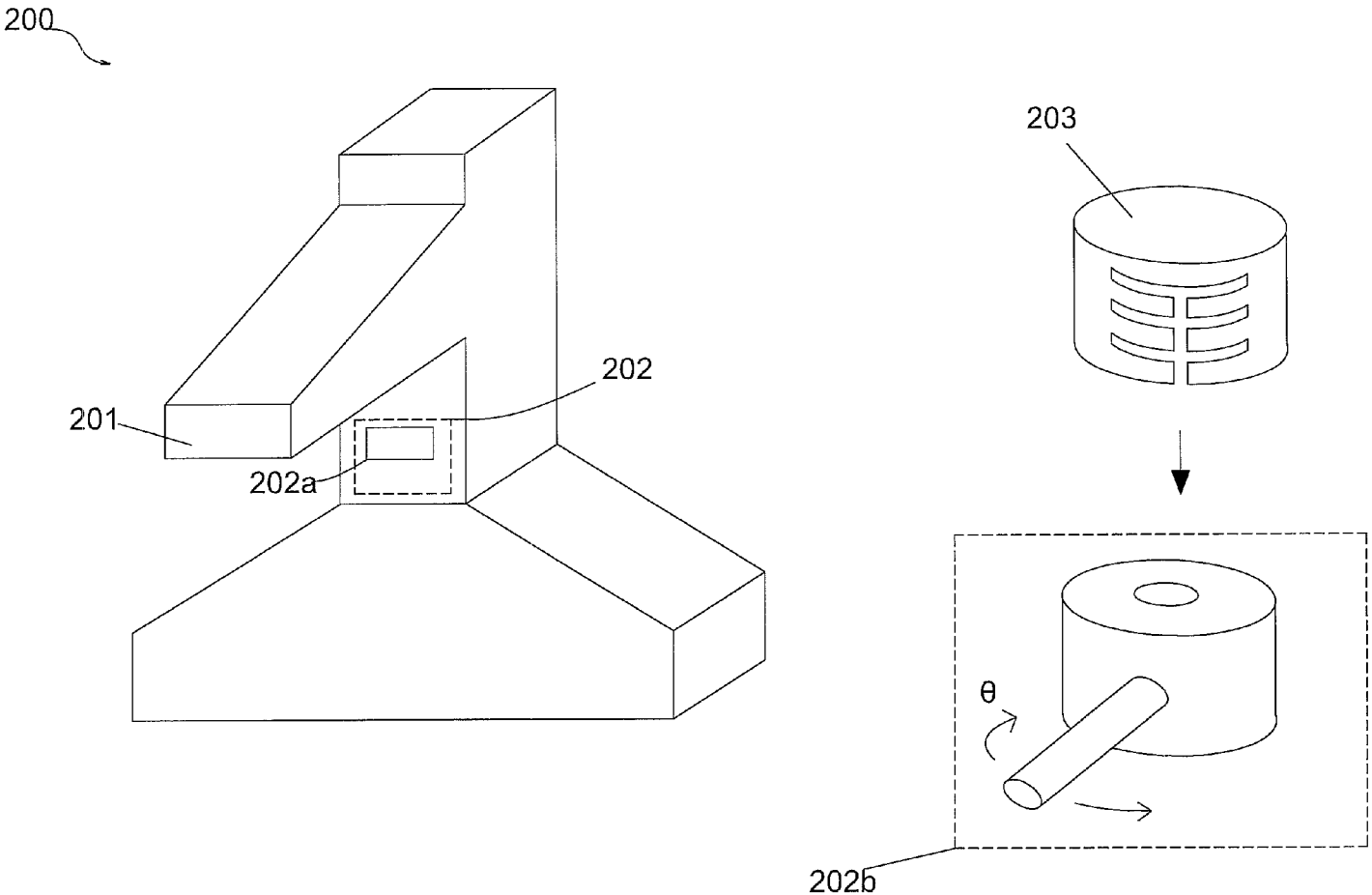
FIG. 2 shows a schematic diagram illustrating the hydrant apparatus according to another embodiment of the invention.

FIG. 2 shows a schematic diagram illustrating the hydrant apparatus 200 according to one embodiment of the invention. As shown in the figure, the hydrant apparatus 200 comprises at least an outlet pipe 201, at least a switch 202, and at least a temperature limiting component 203. The switch 202 comprises a switch detector 202*a* and a water flow regulator 202*b*. The switch detector 202*a* is coupled to the outlet pipe 201.

The switch detector 202*a* can detect an object and start or stop water flow, that can be accomplished by an infrared detector. But, the invention is not limited to this example. In another embodiment, a current-existed or future-developed detector can be used. The water flow regulator 202*b* controls the amount of water flow and adjusts the temperature of water flow.

The temperature limiting component 203 can be a movement limiting structure. The movement limiting structure has a plurality of rails and is jacketed on the water flow regulator 202*b*. The movement limiting structure can be made of metal or plastics, etc. The rail has a predetermined width that corresponds to the shape of the switch. Besides, these rails are used to limit the movement of the water flow regulator 202*b* of the switch 202. In another embodiment, the movement limiting structure can be formed into one piece together with the switch 202.

In this embodiment, when the water flow regulator 202*b* is pushed up, water flow increases. When the water flow regulator 202*b* is pushed down, water flow decreases. When the water flow regulator 202*b* is rotated clockwise, the temperature of the water flow is raised. When the water flow regulator 202*b* is rotated counterclockwise, the temperature of the water flow is lowered. Certainly, the operation of the water flow regulator 202*b* and the corresponding result thereof are not limited to the above mentioned manner. For example, in another embodiment, as the water flow regulator 202*b* is rotated clockwise, the temperature of the water flow is lowered.

The following will describe the working principle of the hydrant apparatus 200 according to the embodiment of the invention. As shown in FIG. 2, as the switch detector 202*a* detects there is an object approaching, the switch detector 202*a* starts water flow and then water flows out from the outlet pipe 201. The amount and the temperature of the water flow are controlled by the water flow regulator 202*b*. Without the temperature limiting component 203, the amount and the temperature of the water flow can be adjusted freely. After the temperature limiting component 203 is jacketed on the water flow regulator 202*b*, the movement limiting structure has rails and thus the rotational angle of the water flow regulator 202*b* is limited to be within θ degrees so that the temperature of the water flow is controlled in a predetermined range for avoiding scald and frostbite. Therefore, when opening the hydrant apparatus 200, a user will not be scalded by hot water and frostbitten by cold water. Besides, after starting for a while, the user can use water with higher temperature or lower temperature.

Figure 3B:
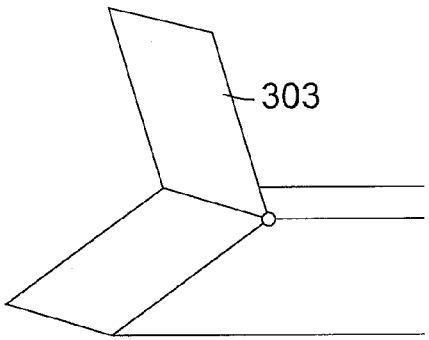
FIG. 3B shows a schematic diagram illustrating a temperature limiting component of FIG. 3A.
Figure 3A:
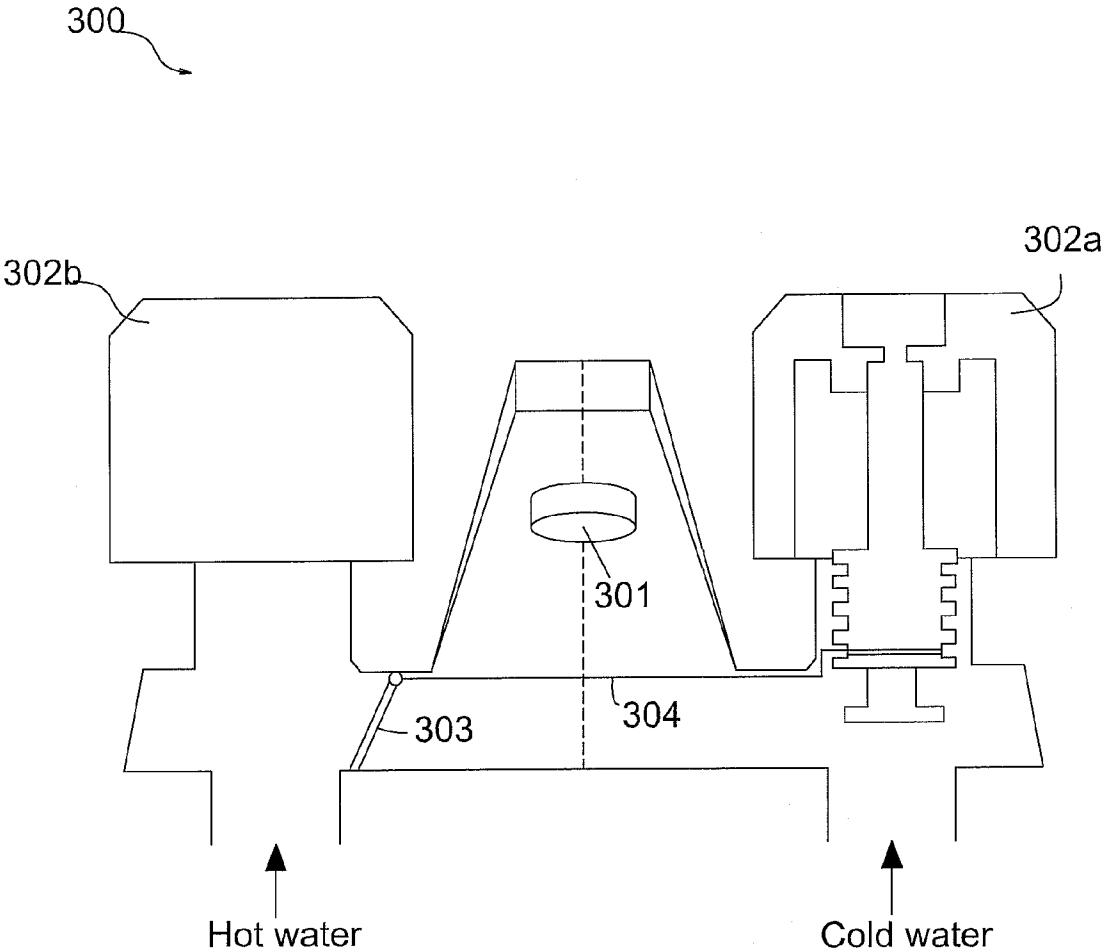
FIG. 3A shows a schematic diagram illustrating the hydrant apparatus according to another embodiment of the invention.

FIG. 3A shows a schematic diagram illustrating the hydrant apparatus 300 according to one embodiment of the invention. As shown in the figure, the hydrant apparatus 300 comprises an outlet pipe 301, a cold-water switch 302*a*, a hot-water switch 302*b*, a temperature limiting component 303, and a coupling structure 304. The temperature limiting component 303 can be a throttle valve. The cold-water switch 302*a*, the hot-water switch 302*b*, and the outlet pipe 301 are coupled together. One end of the coupling structure 304 is coupled to the cold-water switch 302*a* and the other end of the coupling structure 304 is coupled to the temperature limiting component 303. The temperature limiting component 303 is installed between the hot water flow pathway of the hot-water switch 302*b* and the outlet pipe 301 to perform corresponding operation in response to the operation of the cold-water switch 302*a* so as to intercept the hot water flow from flowing toward the outlet pipe 301.

The following will describe the working principle of the hydrant apparatus 300 according to the embodiment of the invention. As shown in FIG. 3A, when the cold-water switch 302*a* is opened, the cold-water switch 302*a* drives the coupling structure 304 to open the temperature limiting component 303 (throttle valve) so that water can freely flow between the hot-water switch 302*b* and the outlet pipe 301 to have hot water flow through the outlet pipe 301. The example of opening or closing the temperature limiting component 303 is shown in FIG. 3B. It should be noted that, after the cold-water switch 302*a* is opened, the hot-water switch 302*b* is opened to mix hot water with cold water so that the temperature control can be achieved. On the contrary, if the cold-water switch 302*a* is not opened, when only the hot-water switch 302*b* is opened, the temperature limiting component 303 is closed and thus hot water cannot flow through the outlet pipe 301. Therefore, when opening the hydrant apparatus 300, a user will not be scalded by hot water. Besides, after starting for a while, the user can use water with higher temperature. Furthermore, those who are skilled in the art understand how to implement a hydrant apparatus to prevent frostbite according to the embodiment as well. Thus, the details will not be repeated hereafter. Obviously, the embodiment of a hydrant apparatus that can prevent frostbite is considered to be also within the scope of the invention.

Figure 4:
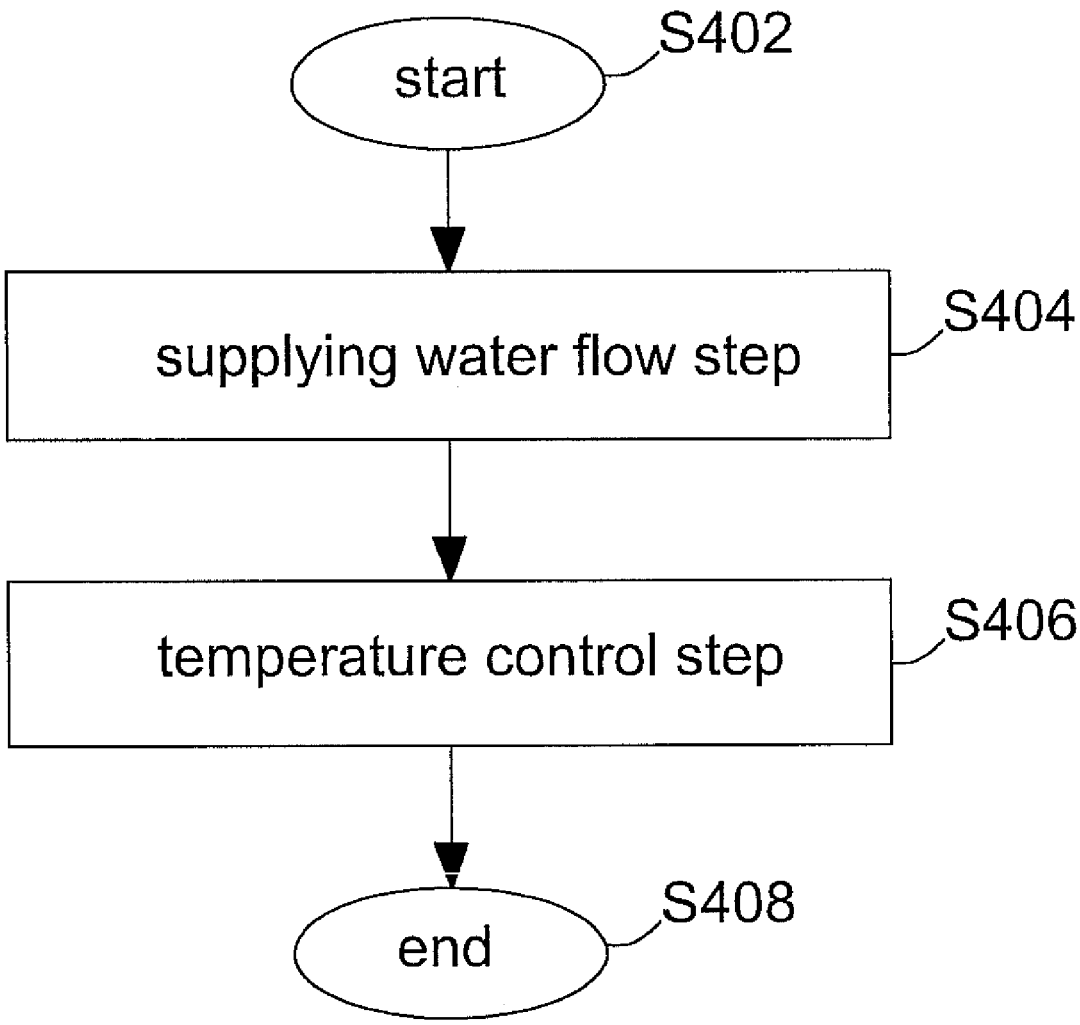
FIG. 4 shows a flow chart illustrating the water discharging method according to one embodiment of the invention.

FIG. 4 shows a flow chart illustrating the water discharging method according to one embodiment of the invention. The method can be applied in a hydrant apparatus and the method comprises the following steps:

Step S402: start;

Step S404: supplying water flow step by a user to open at least a switch of the hydrant apparatus to prepare for supplying water flow;

Step S406: temperature control step to provide temperature control means to determine whether the temperature of the water flow is beyond a predetermined range or not at the moment when the hydrant apparatus is opened and then to intercept the water flow to prevent the water from flowing out of the hydrant apparatus if the temperature is beyond the predetermined range and to have the water flow out of the hydrant apparatus if the temperature is within the predetermined range;

Step S408: end.

It should be noted that the temperature control means can also detect the temperature of the water flow after water flows out of the hydrant apparatus. Then, the temperature control means provide another water flow with relatively low temperature to lower the temperature of the water flow if the temperature of the water flow is beyond the predetermined range to thereby avoid scald. As the temperature of the water flow is below the predetermined range, the temperature control means provide another water flow with relatively high temperature to raise the temperature of the water flow to thereby avoid frostbite. Or, the temperature control means sense the temperature of the water flow after water flows out of the hydrant apparatus. Then, the temperature control means adjust the water outlet quantity of the hydrant apparatus along with the variation of the temperature of the water flow. When the temperature is beyond or below the predetermined range, the temperature control means reduce or intercept the water flow of the hydrant apparatus. Or, the temperature control means provide cold-water flow to assure that the temperature of the water flow is low at the moment when a user opens the hydrant apparatus. Then, after water flows out of the hydrant apparatus for a while and when the temperature of the mixture of the water flow and the cold-water flow is beyond the predetermined range, the temperature control means intercept the water flow of the hydrant apparatus to prevent the user from being scalded at the moment when the hydrant apparatus is opened or in use for a while. Or, in relatively cold region, when a user opens the hydrant apparatus, the temperature control means provide warm-water flow to assure that the temperature of the water flow is appropriate (at comfortable temperature). After the water flows out of the hydrant apparatus for a while and when the temperature of the mixture of the water flow and the cold-water flow is below or beyond the predetermined range, the temperature control means intercept the water flow of the hydrant apparatus prevent the user from being frostbitten at the moment when the hydrant apparatus is opened or in use for a while.

It should be noted that the embodiment is described to limit the temperature of the water flow within a predetermined range but the invention is not restricted to this example. The temperature of the water flow can be limited within two or more than two ranges. For example, when the hydrant apparatus is in use, the predetermined temperature range is 40~50° C. The predetermined temperature range is 30~40° C. at the moment when the hydrant apparatus is opened.

In conclusion, the hydrant apparatus and the water discharging method according to the invention utilize the temperature control means, such as temperature limited component, to limit the temperature of water flow to thereby control the water temperature within a safe temperature range for human beings at the moment when the hydrant apparatus is opened. In addition, the water temperature is controlled within a predetermined range while the hydrant apparatus is in use. Therefore, the hydrant apparatus and the water discharging method according to the invention can prevent a user from being scalded or frostbitten at the moment when the hydrant apparatus is opened and while the hydrant apparatus is in use. Thus, safety protection while using a hydrant apparatus can be achieved.

Although the present invention has been fully described by the above embodiments, the embodiments should not constitute the limitation of the scope of the invention. Various modifications or changes can be made by those who are skilled in the art without deviating from the spirit of the invention.

What is claimed is:

1. A water discharging method applied in a hydrant apparatus, comprising:

opening at least one switch of the hydrant apparatus to prepare for supplying water flow;

and providing temperature control means to determine whether the temperature of the water flow is beyond a predetermined range or not at the moment when the hydrant apparatus is opened and then to intercept the water flow to prevent the water from flowing out of the hydrant apparatus if the temperature is beyond the predetermined range and to have the water flow out of the hydrant apparatus if the temperature is within the predetermined range;

wherein the temperature control means sense the temperature of the water flow after water flows out of the hydrant apparatus; and then adjust the amount of the water flow of the hydrant apparatus along with the variation of the temperature of the water flow and reduce or intercent the water flow of the hydrant apparatus when the temperature is beyond or below the predetermined range.

2. The method according to claim 1, wherein the temperature control means provide cold-water flow to assure that the temperature of the water flow is low at the moment when a user opens the hydrant apparatus; and then intercept the water flow of the hydrant apparatus after water flows out of the hydrant apparatus for a while and when the temperature of the mixture of the water flow and the cold-water flow is beyond the predetermined range.

3. The method according to claim 1, wherein the temperature control means provide warm-water flow to assure that the temperature of the water flow is appropriate at the moment when a user opens the hydrant apparatus; and then intercept the water flow of the hydrant apparatus after water flows out of the hydrant apparatus for a while and when the temperature of the mixture of the water flow and the cold-water flow is below or beyond the predetermined range.

4. A hydrant apparatus, comprising:

at least an outlet pipe for flowing water out of the hydrant apparatus;

at least a switch coupled to the outlet pipe for controlling the water flow or adjusting the temperature of the water flow, or both of controlling and adjusting the water flow; and at least a temperature limiting component that limits the temperature of the water flow within a predetermined range;

wherein the temperature limiting component is provided on the switch;

wherein the temperature limiting component is a movement limiting structure having at least one rail and the rail is used to limit the movement of the switch.

5. The hydrant apparatus according to claim 4, wherein the rail has a predetermined width that corresponds to the shape of the switch.

6. The hydrant apparatus according to claim 4, wherein the movement limiting structure and the switch are formed in one piece.

7. The hydrant apparatus according to claim 4, wherein the hydrant apparatus further comprises a coupling structure, and one end of the coupling structure is coupled to the cold-water switch and the other end of the coupling structure is coupled to the temperature limiting component.

8. The hydrant apparatus according to claim 7, wherein, if the cold-water switch is opened, the cold-water switch drives the coupling structure to open the temperature limiting component so that water can freely flow between the hot-water switch and the outlet pipe to have hot water flow through the outlet pipe, and if the cold-water switch is not opened, when only the hot-water switch is opened, the temperature limiting component is closed and thus hot water cannot flow through the outlet pipe.

* * * * *